United States Patent [19]

Finkelstein

[11] Patent Number: 4,884,842

[45] Date of Patent: Dec. 5, 1989

[54] BODY SUPPORTING CHAIR

[76] Inventor: Sarah Finkelstein, 826 Robert E. Lee Blvd., Charleston, S.C. 29412

[21] Appl. No.: 229,451

[22] Filed: Aug. 8, 1988

[51] Int. Cl.[4] ..... A47C 1/02

[52] U.S. Cl. ..... 297/331; 297/337; 297/336; 297/349

[58] Field of Search ..... 297/331, 335, 336, 338, 297/345, 313, 364, 314, 191, 357, 349

[56] References Cited

U.S. PATENT DOCUMENTS

| | | | |
|---|---|---|---|
| 620,816 | 3/1899 | Westland | 297/314 |
| 835,992 | 11/1906 | Truax | 297/336 |
| 1,677,434 | 7/1928 | Dorton | 297/364 |
| 2,043,287 | 6/1936 | Dorton | 297/336 |
| 2,550,992 | 5/1951 | Goodrich . | |
| 2,627,897 | 2/1953 | Apel | 297/336 |
| 2,673,736 | 3/1954 | Fiumedoro . | |
| 3,189,380 | 6/1965 | Reguitti | 297/191 |
| 3,532,336 | 10/1970 | Baker . | |
| 3,711,152 | 1/1973 | Sirpak et al. | 297/345 |
| 3,790,974 | 2/1974 | Johansson | 297/417 |
| 3,813,091 | 5/1974 | Metzger . | |
| 3,948,379 | 4/1976 | Warner | 297/217 |
| 3,949,983 | 4/1976 | Tommasino . | |
| 4,238,097 | 12/1980 | Clausen et al. | 297/345 |
| 4,239,200 | 12/1980 | Sarrafian et al. . | |
| 4,377,308 | 3/1983 | Pisanu . | |
| 4,408,743 | 10/1983 | DeWitt et al. | 297/345 |
| 4,571,761 | 2/1986 | Perlin . | |

OTHER PUBLICATIONS

Ergoform, Inc. Brochure.

*Primary Examiner*—Francis K. Zugel
*Attorney, Agent, or Firm*—Karen M. Gerken; Martin P. Hoffman; Mitchell B. Wasson

[57] ABSTRACT

A body supporting chair in the form of a generally U-shaped seat member rotatably mounted upon a central support post by support means allowing the seat member to assume operative and inoperative positions with respect to the support post. The seat member is adapted for oscillatory movement with respect to the support means, and is intended to be adjusted vertically with respect to the support post. The support post is mounted on a base member for supporting the chair on a horizontal support surface.

16 Claims, 6 Drawing Sheets

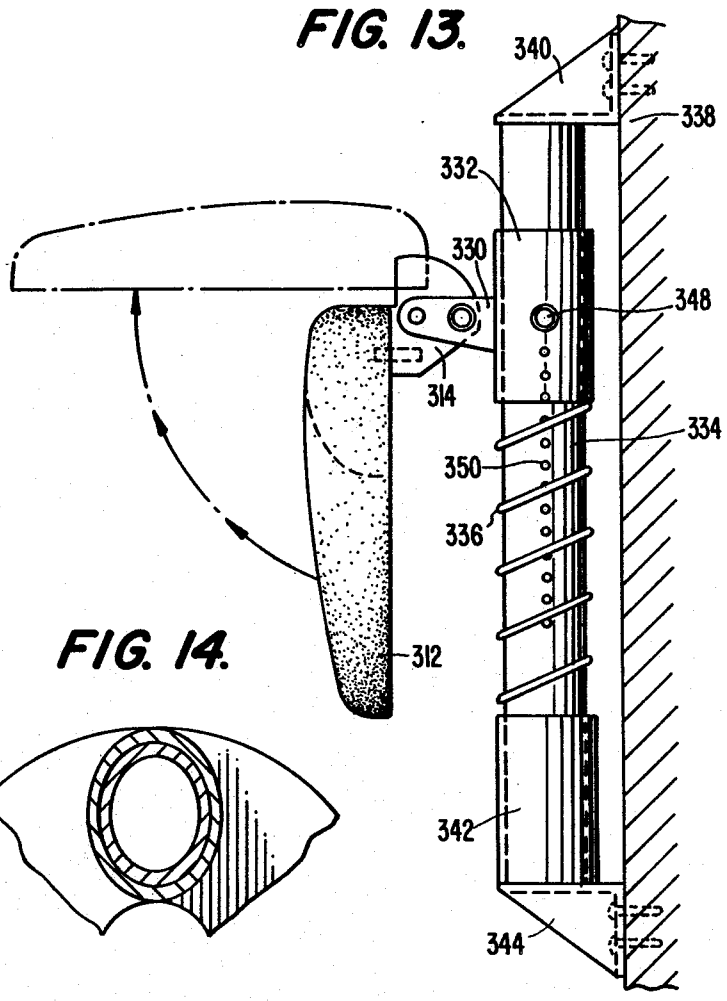
FIG. 13.
FIG. 14.
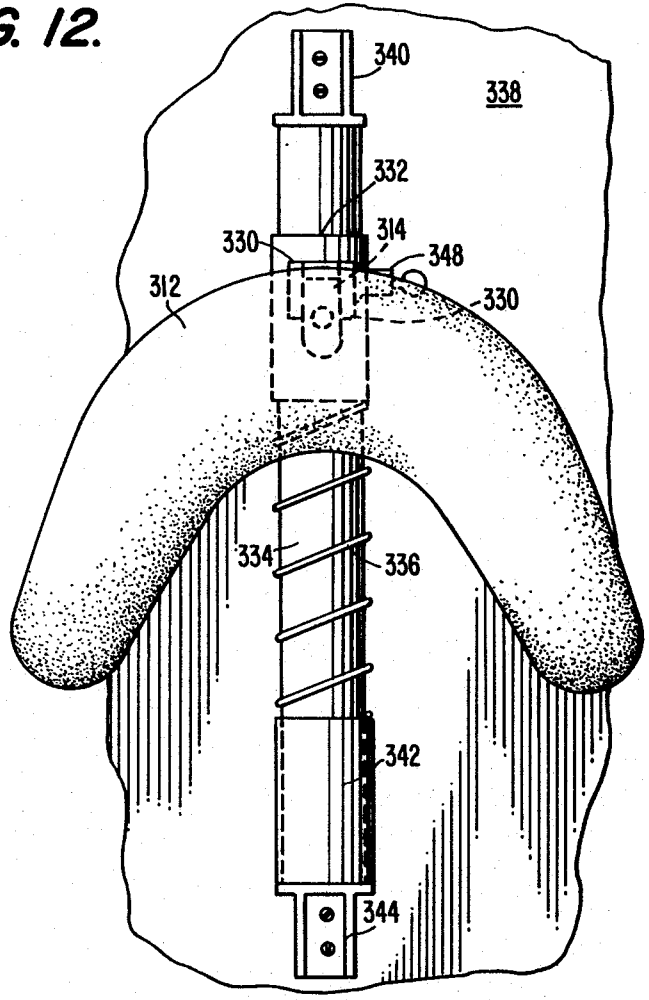
FIG. 12.

BODY SUPPORTING CHAIR

BACKGROUND OF THE INVENTION

1. Field of the Invention

The invention pertains generally to a body supporting chair and, more particularly, to a chair or seat which is specifically designed to facilitate marital copulation. It often becomes necessary for couples to restrain from sexual relations when the woman is pregnant and has reached a certain stage in the pregnancy. In absence of any medical complications due to pregnancy, this abstinence is attributable to the fact that is is uncomfortable for the woman to bear the weight of the man, and difficult for her to engage in the movements required to assume various positions. Additionally, many couples experience a certain amount of mental anguish during intimacy in the course of pregnancy, fearing that the man's weight will harm the unborn child. Thus, concern for the baby's safety frequently leads to restraint in couples otherwise not medically prohibited from engaging in sexual relations.

Couples wherein one of the partners has a physical malday also experience difficulties when performing sexual relations. Numerous acute and chronic medical conditions are characterized by indications which may curtail a partner's ability to move naturally and/or support, even partially, the weight of another person. These medical conditions may make it painful, and even detrimental, for couples to copulate. Chief among the latter types of problems are back injuries and weaknesses, leg and arm disabilities, and post-operative tissue damage and soreness.

In addition to the relatively minor medical conditions noted above, there are more severe physical limitations which create problems for couples engaging in sexual relations. A handicapped individual, for example, may find it physically and emotionally difficult to self-confidently participate in sexual intimacy. A physically handicapped person may not only encounter positional difficulties, but may also experience a lack of self-confidence due to complete reliance upon the other partner in assuming a reclining position.

Thus, the need exists for a body supporting chair which is specifically designed for and adapted to comfortably and securely support a person for copulation. The need exists for such a chair to be easily and safely usable by physically impared persons. Moreover, it is desirable that such a chair be capable of adjustment to satisfy individual positional requirements, and that it be visually attractive. While primarily fulfilling the needs of those possessing temporary or permanent physical impairments, it is obvious that such a chair would also be beneficial for the variety it offers to couples not curtailed by physical limitations.

The present invention addresses and fulfills the foregoing need by providing a body supporting chair which comfortably and safely supports a woman in a seated position for sexual relations. Because the woman is seated, it is not necessary for her to possess lower body strength, or support any of the weight of her mate. Moreover, the fact that the man may stand provides advantages in cases where it might be uncomfortable for the man to be prone. The seat of the present invention is particularly configured to allow close association between the partners, and is adjustable vertically with respect to the floor or other supporting surface in order to accommodate the comfort and various physical characteristics of both partners. The latter feature also permits the seat to be positioned so as to allow a handicapped individual to make the transfer from a wheelchair to the seat, and vice versa, in a safe and dignified manner, thereby restoring self-confidence and self-reliance. The seat is adapted for rotation in the horizontal plane to provide additional degrees of movement which, due to physical conditions, might not normally be available to the partners. Additionally, the seat may have a built-in vibrator.

The present invention is further characterized by the fact that it may be easily and safely operated by physically impared persons. Vertical adjustment of the seat is easily accomplished, not requiring any heavy lifting or complex manipulation. Furthermore, the body support of the present invention is adaptable to diverse interior design preferences in that it is attractive, it is mountable on a horizontal or vertical support surface, and it may assume the form of a standing piece of furniture, or it may be folded into a generally concealed position when not in use.

2. Description of the Prior Art

It is known in the prior art to provide a chair or support for facilitating copulation. For example, U.S. Pat. No. 4,571,761, issued to Perlin on Feb. 25, 1986, discloses a lounge or bed intended to provide a more comfortable means of copulation by allowing a woman to stand vertically oven a man lying horizontally on the bed, with the thighs of a woman fitted into cut-away areas on the bed, thereby establishing closer contact. It is apparent that the latter arrangement requires that the woman be physically agile and of normal strength, and that the man support at least part of the woman's weight.

U.S. Pat. No. 3,813,091, issued on May 28, 1974 to Metzger, similarly teaches a couch for supporting a person's body while consumating an act of intimacy. The couch is formed of interrelated head, body and foot portions. The body portion supports the trunk of the user, and the foot portion supports the thighs of the user in an inclined manner. This device, too, requires the user to assume a reclining position and to support the weight of a partner.

The prior art also teaches a chair having a seat which is rotatable. U.S. Pat. No. 2,550,992, issued on May 1, 1951 to Goodrich, is directed to an exercising chair wherein the seat is supported by a shaft mounted for rotation in a pedestal base. The seat is adapted to be oscillated back and forth by the user with respect to a stationary back member and arm supports. The seat is not intended to facilitate copulation, and is not vertically adjustable.

Sarrafian et al, which issued on Dec. 16, 1980 as U.S. Pat. No. 4,239,200, also shows a table, in this case for a person's feet, which is adjustable in a horizontal plane. The table is provide with a pair of outwardly diverging branches which are pivotably adjustable in a horizontal plane.

It is further known in the prior art to provide a support for therapeutic purposes which is adjustable in a vertical direction. U.S. Pat. No. 4,377,308, for instance, which issued on Mar. 22, 1983 to Pisanee, discloses an odontological chair having a base adapted for upward and downward adjustment. Similarly, U.S. Pat. No. 3,949,983 to Tommasino, which issued on Apr. 13, 1976, discloses a physical therapy board characterized by vertically adjustable knee and foot rests.

It is evident from the foregoing that the prior art does not provide a body support for sexual relations as specifically characterized by the present invention.

SUMMARY OF THE INVENTION

The invention pertains to a body supporting chair for facilitating copulation. The body supporting chair comprises a specially configured padded seat member mounted on a vertical support post associated with a base which rests upon a horizontal support surface. According to the preferred embodiment, the seat member is rotatably mounted with respect to the support post by means of a seat support segment plate, which allows the seat member to assume operative and inoperative positions. The seat member is intended to be locked in the operative position by means of a detent assembly. Additionally, a swivel pin member on the segment plate permits oscillatory movement of the seat member with respect to the support post in a horizontal plane. The seat member is adapted to be adjusted vertically with respect to the support post by downward movement of the seat member against the force of a spring. The seat member is adapted to be locked into position at the desired vertical location by means of a second detent assembly.

Several alternative embodiments for the invention are disclosed, relating to alternative means for raising and lowering the seat member, adapting the body support chair to function as a valet, adjustably mounting the seat member with respect to various vertical support systems, fixedly mounting the seat member, and having a non-oscillating seat member.

BRIEF DESCRIPTION OF THE DRAWINGS

FIG. 12 is a front elevational view of a fourth alternative embodiment for the invention, showing the seat in the inoperative position using a single vertical support column mounted to a fixed surface;

FIG. 13 is a side elevational view of the embodiment of FIG. 12, showing the operative position for the seat in phantom;

FIG. 14 is a top cross-sectional view of a support post for the present invention, showing a non-circular configuration;

DESCRIPTION OF THE PREFERRED EMBODIMENT

Figure 2:
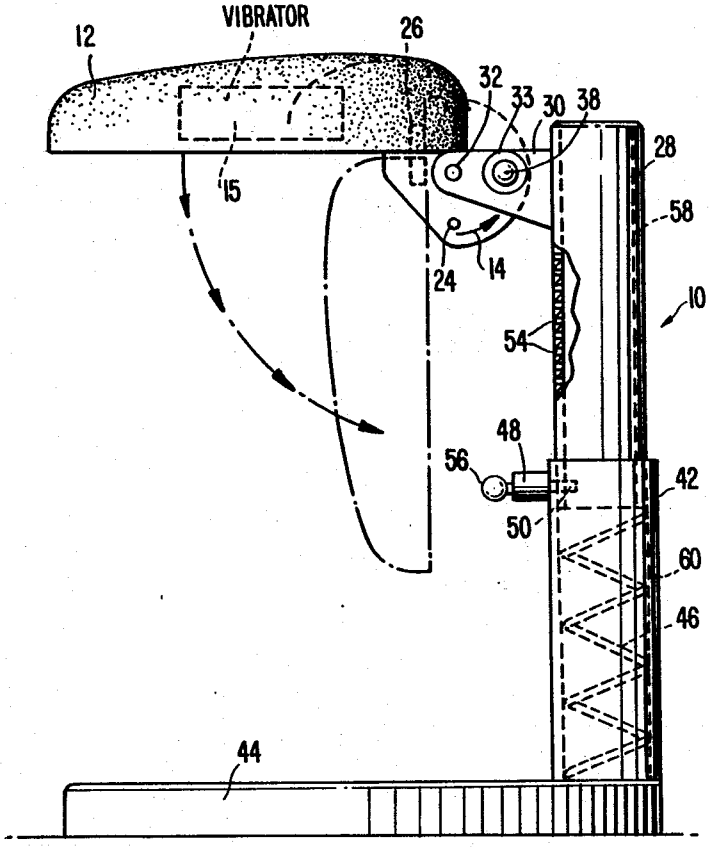
FIG. 2 is a side elevational view of the embodiment of FIG. 1, showing the folded or inoperative position for the seat in phantom.
Figure 3:
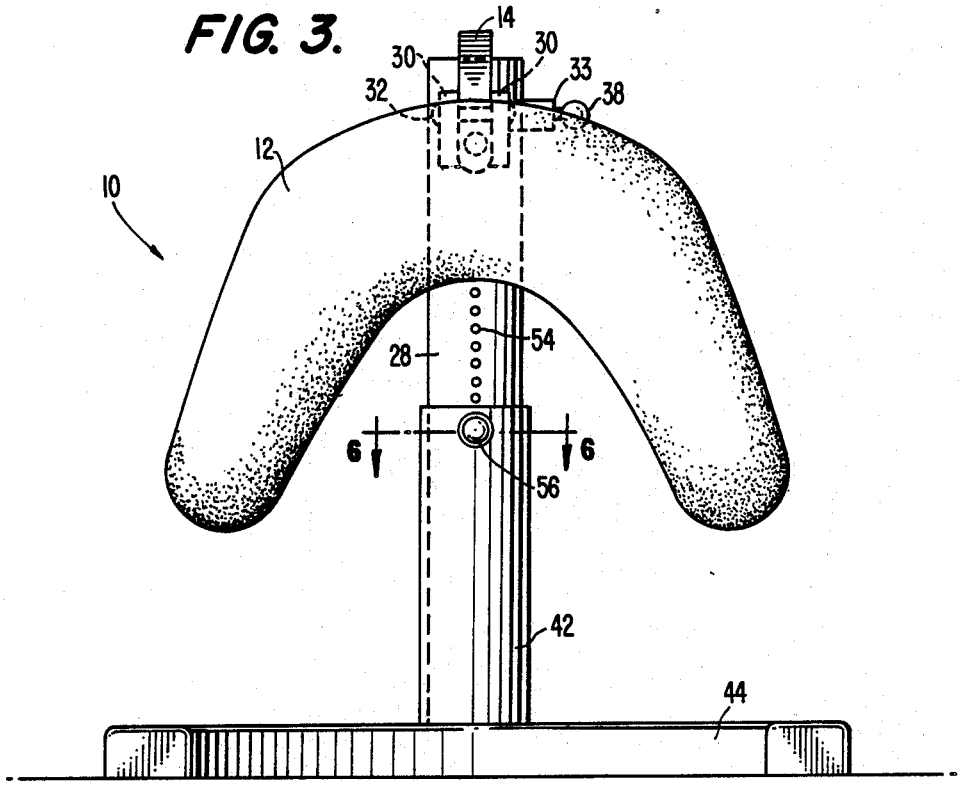
FIG. 3 is a front elevational view of the embodiment of FIG. 1, showing the seat in the folded position.
Figure 4:
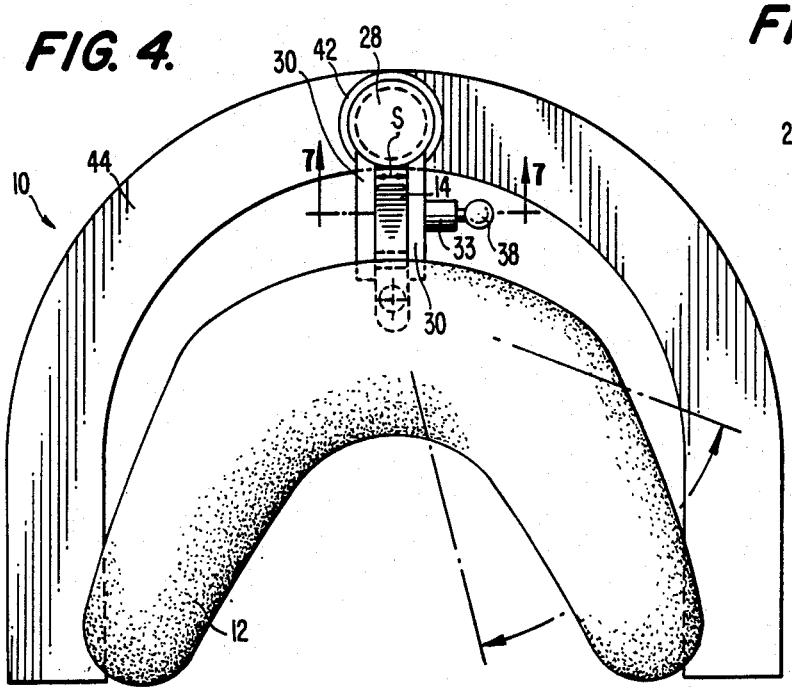
FIG. 4 is a top plan view of the embodiment of FIG. 1 with the seat in the operative position.
Figure 5:
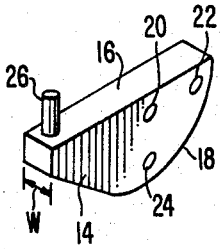
FIG. 5 is a perspective view of the seat support segment plate utilized in conjunction with the embodiment of FIG. 1.

Referring to the drawings and, in particular, to FIGS. 1–7, a preferred embodiment for the body supporting chair is indicated generally at 10. The body supporting chair comprises a seat member 12 of generally inverted U-shape configuration, as viewed from the top in FIG. 3. The seat member is preferably of one-piece construction, being fabricated from a cushioned vinyl, plastic or other moisture-proof material. As depicted schematically in FIG. 2, the seat may be provided with a built-in vibrator 15. As best shown in FIGS. 3 and 4, a seat support segment plate 14 is suitably secured to the bottom of the seat member at the center of its arcuate rear edge. The preferred configuration for the seat support segment plate being illustrated in FIG. 5. As shown therein, the seat support segment plate is defined by a generally straight upper edge 16, and a curved lower side edge 18. As can be seen in FIG. 2, when the seat member is secured to the seat support segment plate, the bottom of the seat member is generally supported on the straight upper edge of the plate. A pair of through holes 20,22 is provided in the plate proximate the upper edge. A through hole 24 is provided in the plate proximate the lower side edge, as is further depicted in FIG. 5. An upstanding seat swivel pin 26 is also provided on the upper edge.

Figure 1:
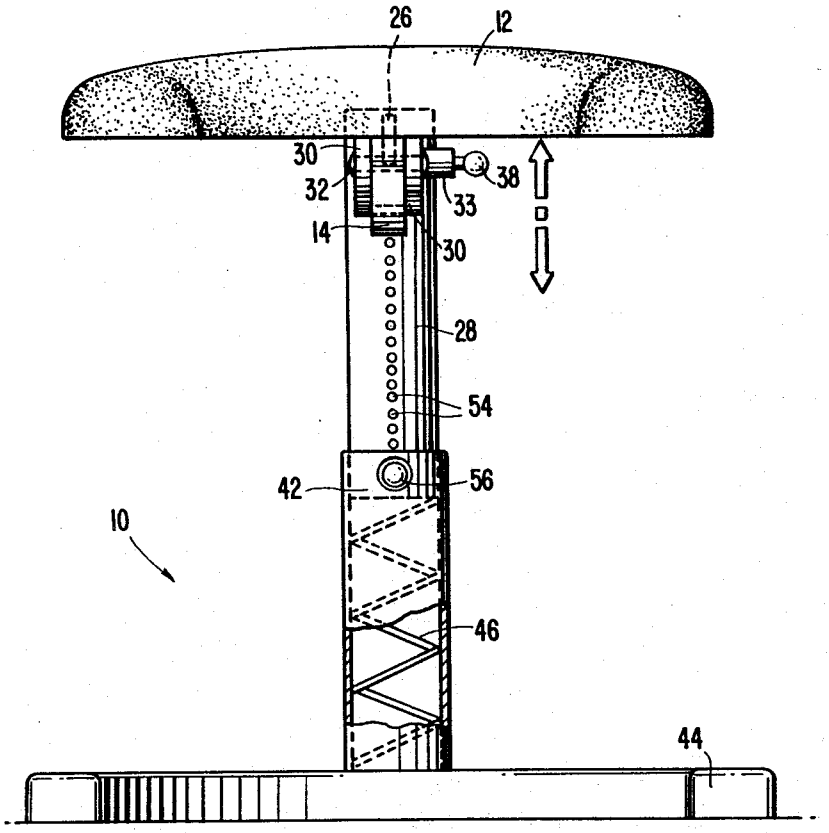
FIG. 1 is a front elevational view of the preferred embodiment of the invention, showing a portion of the single vertical support column broken away and showing the compressed helper spring in phantom.

The seat member is adapted to be operatively associated with and supported by a central vertical hollow support post 28, as shown in FIGS. 1, 2 and 3. For purposes of mounting the seat member with respect to the post, a pair of outwardly extending support flanges 30 is provided on the support post, having a space S therebetween, shown in FIG. 4, generally equal to the width W, shown in FIG. 5, of the seat support segment plate. The seat member, with its attached seat support segment plate, is secured to the post by means of securing means 32, in the form of a suitable headed bolt or the like, being extended through aligned holes (not separately numbered) in the flanges, and the through hole 20 in the segment plate. The relationship between the flanges, the segment plate and the securing means when the seat member is secured to the support post is best depicted in FIGS. 1 and 2. It is also evident from FIG. 2 that the securing means is such as to allow downward rotation of the seat member with respect to the support post, as shown by the arrows in FIG. 2.

Figure 7:
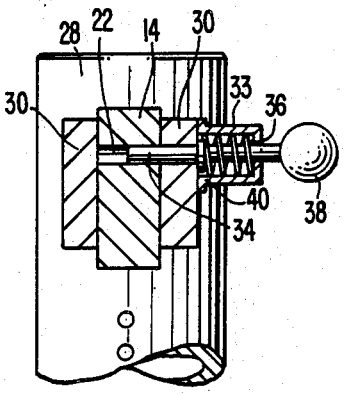
FIG. 7 is a partial vertical cross-sectional view taken along line 7—7 of FIG. 4.

The operative position for the seat member, as shown in FIGS. 1 and 2, is obtained when the upper edge of the segment plate is oriented generally perpendicular with respect to the support post. In order to positively and securely maintain the seat support segment plate in the operative position, a spring loaded detent assembly 33 is associated with a through hole (not separately numbered) in one of the support flanges aligned with the through hole 22 in the segment plate. With particular reference to FIG. 7, it can be seen that the keeper end 34 of the detent assembly is urged by spring 36 into a position wherein it passes through one of the support flanges and into through hole 22 of the segment plate, thereby effectively preventing rotation of the segment plate with respect to the flanges and, hence, the support post. In order to rotate the seat member downwardly around the securing means 32, as indicated by the arrows in FIG. 2, it is merely necessary to manually outwardly retract the ball end 38 of the detent assembly, causing the keeper end 34 to be withdrawn from the through hole 22 in the segment plate. A stop member 40, shown in FIG. 7, limits the degree of outward retraction of the keeper end to that required to clear the segment plate. The latter procedure may be undertaken quite easily by the user, thereby allowing the seat to be moved downwardly to the folded or inoperative position shown in FIG. 3 and in phantom in FIG. 2.

The support post 28 is slidably received within an outer vertical sleeve member 42, which terminates at its lower end in a base 44 adapted to support the entire assembly on a horizontal support surface such as the floor or the like. The base may rest independently upon the floor, or it may be secured to the floor in a conventional manner.

Figure 6:
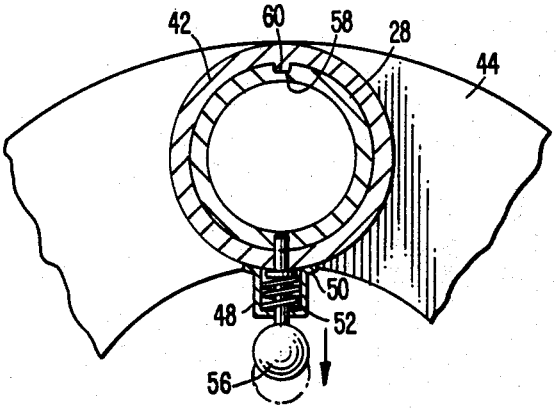
FIG. 6 is a partial horizontal cross-sectional view taken along line 6—6 of FIG. 3 and showing the retracted position of the detent in phantom.

As best illustrated in FIGS. 1 and 2, a spring 46 is disposed within the sleeve member so as to urge the support post in an upward direction. The upward travel of the support post is limited, however, by means of a detent assembly 48, shown in detail in FIG. 6. As depicted in FIG. 6, the keeper end 50 of the detent assembly is urged by spring 52 to extend within aligned through holes (not separately numbered) formed in the sleeve member and the support post, thereby locking the support post against vertical movement, up or down, with respect to the sleeve member.

FIGS. 1, 2 and 3 show that the support post is provided with additional closely spaced through holes 54 which allow the support post to be locked into a variety of vertical positions for adjusting the vertical height of the seat member with respect to the floor. These through holes are preferably spaced ½ inch to ¾ inches apart so as to permit fine adjustments for accommodating the comfort and various physical characteristics of the users. As shown in FIG. 6, the support post is vertically adjusted simply by manually retracting the ball end 56 of the detent assembly until the keeper end is withdrawn from the through hole in the post, in the manner described in connection with detent assembly 33. It is then only necessary to press the support post or the seat member downwardly, against the force of the spring 46, and to release the ball end of the detent when the desired vertical height for the seat is obtained, whereupon the keeper end of the detent assembly will automatically lockingly engage the appropriate aligned through hole 54 on the support post. The fact that the seat member does not have to be lifted to achieve vertical adjustment makes the invention safe and easy to use for pregnant women and those who may possess relatively little physical strength.

In order to prevent undesirable rotation of the support post within the sleeve member, the outer surface of the support post is provided with a groove 58 particularly configured to cooperate with a corresponding projection 60 provided on the inner surface of the sleeve member 12 illustrated in FIG. 6.

The seat swivel pin 26 discussed above, permits rotation of the seat member from side to side in a horizontal plane with respect to the seat support segment plate, as shown in phantom in FIG. 4, merely by moving the seat member the desired amount and in the desired oscillation.

Figure 8:
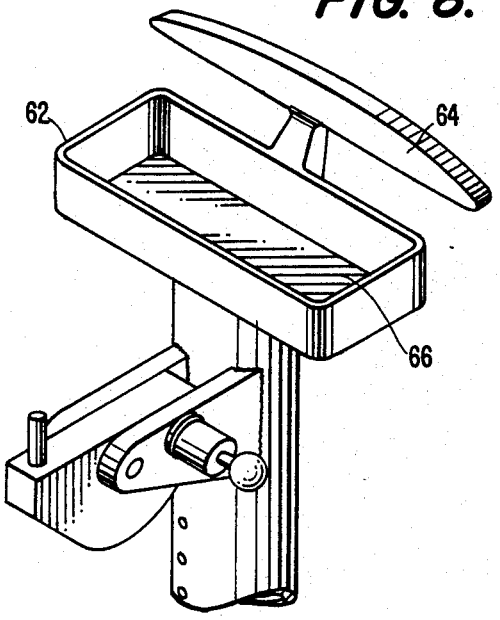
FIG. 8 is a partial perspective view of a first alternative embodiment for the invention, showing a hanger and receptacle.

FIG. 8 particularly illustrates a first alternative embodiment for the invention. The first alternative embodiment shown in FIG. 8 is, for all intents and purposes, identical to the embodiment discussed in connection with FIGS. 1–7, except that a combination clothes hanger and tray member 62 is provided on the upper end of the support post. The clothes hanger 64 is adapted to have items of clothing hung thereon, and the tray 66 serves as a container for coins, jewelry and other personal items.

Figure 9:
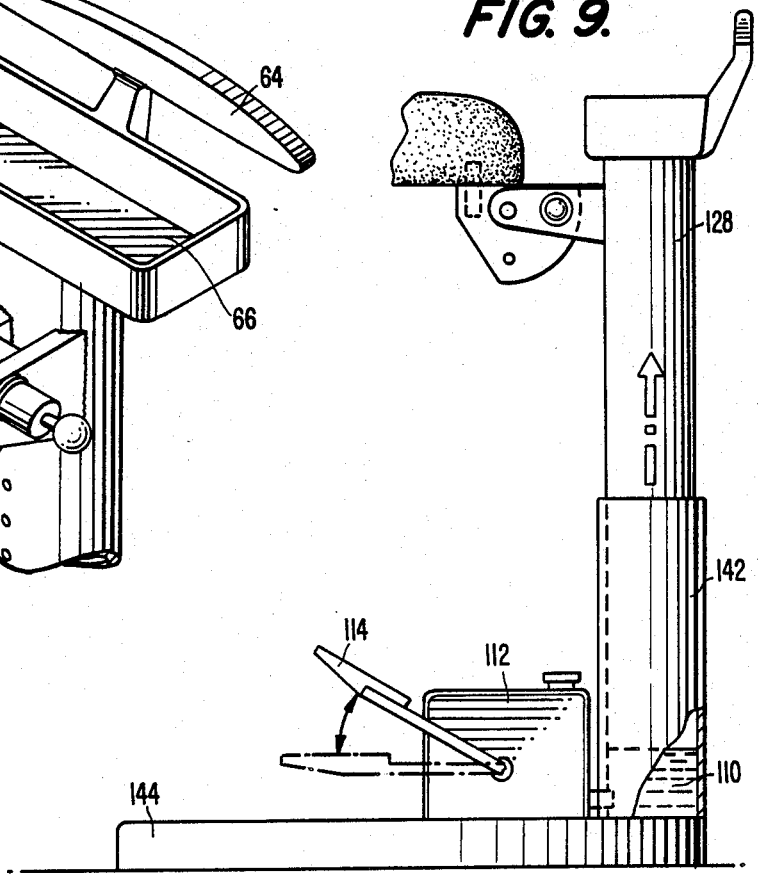
FIG. 9 is a partial side elevational view of a second alternative embodiment for the invention, showing a hydraulic foot press to lift the seat member.

A second alternative embodiment for the invention is particularly depicted in FIG. 9. The seat member, the seat support segment plate and the support flanges for the second alternative embodiment are the same as those described in connection with the preferred embodiment of FIGS. 1–7. The manner and means in which the foregoing structural elements are operatively secured is also the same as that previously discussed. The distinctions associated with the second alternative embodiment of FIG. 9 reside in the means for vertically adjusting the support post with respect to the sleeve member. Thus, it can be seen in FIG. 9 that support post 128, which is solid, has its lower end received within a sleeve member 142 attached to base 144. The sleeve member 142 behaves as a cylinder, and the support post 128 as a piston, for purposes of raising and lowering the support post by means of hydraulic fluid 110 in the sleeve member being suitably pressurized by hydraulic pump 112. The hydraulic pump is provided with a foot operated pedal 114 for purposes of effecting vertical upward movement of the support post by pressing down on the pedal. The support post may be moved downwardly merely by pushing down on the seat member or the support post. It should be obvious to one skilled in the art that the hydraulic pump and fluid could just as easily be replaced with an electric motor and suitable electrical connections and controls for achieving upward and downward vertical adjustment of the support post.

Figure 11:
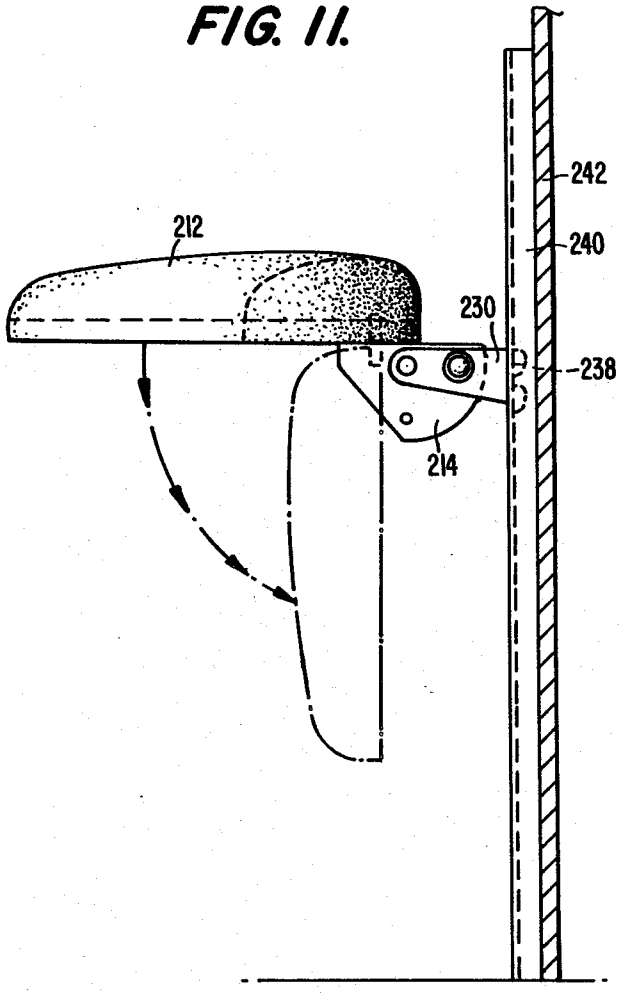
FIG. 11 is a side elevational view of the embodiment of FIG. 10, showing the inoperative position for the seat in phantom.
Figure 10:
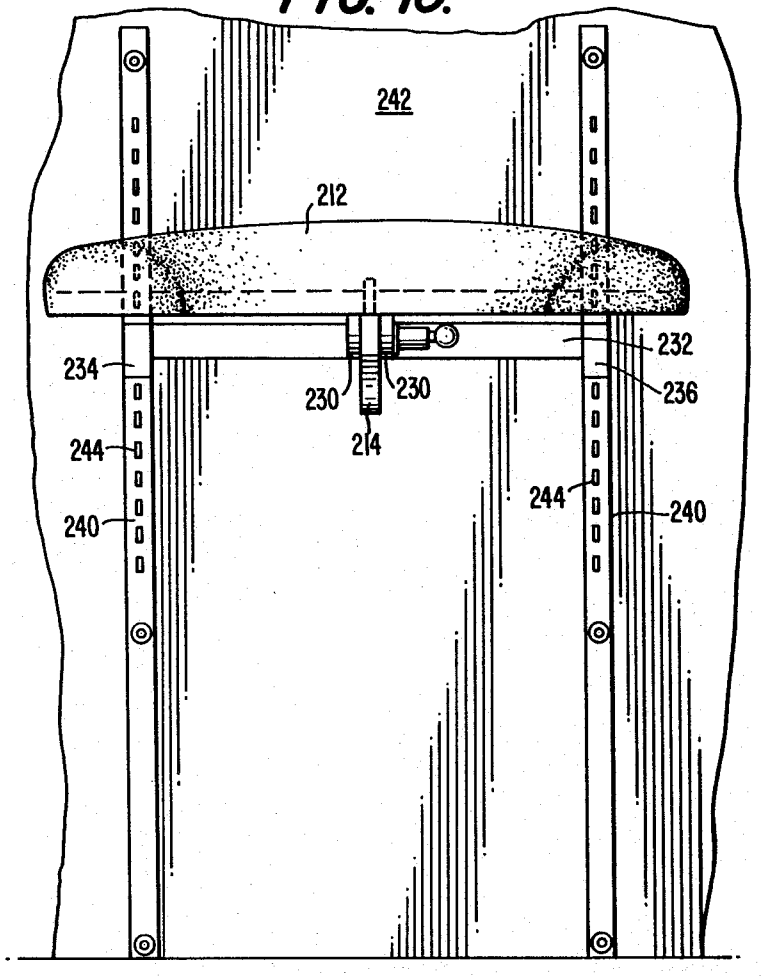
FIG. 10 is a front elevational view of a third alternative embodiment for the invention, showing a seat member mounted to a wall or fixed surface by two tracks.

A third alternative embodiment for the body supporting chair is shown in FIGS. 10 and 11. The body supporting chair illustrated therein comprises a seat member 212 secured to a seat support segment plate 214 which, in turn, is rotatably associated with support flanges 230 in the manner described in connection with FIGS. 1–7. The support flanges 230 extend outwardly from and generally perpendicular to a bracket member 232. The bracket member has a pair of side ends 234,236, each of which is secured, as by screws 238 or the like, to a track member 240 mounted on a wall 242. Each of the track members is provided with a plurality of closely situated openings 244 for securing the bracket to the wall at the desired vertical height.

FIGS. 12 and 13 illustrate a fourth alternative embodiment for the invention. The fourth alternative embodiment relates to a body supporting chair including a seat member 312 secured to a seat support segment plate 314, which is rotatably associated with support flanges 330. The features, interrelationship and mode of operation for the latter elements is the same as was previously discussed in connection with the preferred embodiment and need not be repeated here. The support flanges 330 are secured to, preferably being formed integral with, an upper support sleeve member 332. The upper suport sleeve member is slidably disposed over a support post 334, around which is located a spring member 336 that urges the upper sleeve member upwardly with respect to the support post. The upper end of the support post is fixedly secured to a wall 338 or other vertical support surface by means of securing flanges 340. The lower end of the support post is fixedly received in a lower sleeve support member 342, which is fixedly secured by means of securing flanges 344 to the wall 338.

The upper sleeve support member is provided with a detent assembly 348 which serves to lock the upper sleeve member against vertical movement along the support post due to the keeper end of the detent assembly being received within aligned through holes in the upper sleeve member and the support post. The structural details and manner of operation of the detent assembly are the same as that discussed in connection with the detent assembly 48 of FIGS. 1–7. The support post 334 is provided with a plurality of closely spaced through holes 350 for vertical adjustment of the seat member. The seat member is adapted to be lowered from the position shown in FIG. 13 by manually retracting the detent and pushing down on the seat member against the force of the spring member. The seat member is locked at the desired height by releasing the detent so that its end is received within the appropriate aligned holes in the upper sleeve member and the support post.

FIG. 14 serves to illustrate an alternative configuration for the various support posts and sleeve members. Although the support posts and sleeve members thus far shown have been of circular configuration, it would be obvious to one of ordinary skill in the art that any other feasible configuration could be adapted, the oval configuration illustrated in FIG. 14 providing one such example. Indeed, alternative configurations for the support post and sleeve members, for example, square, rectangular, etc., would discourage rotation between the respective members, thereby eliminating the need for the cooperating groove and projection means described in connection with FIGS. 1–7.

Figure 15:
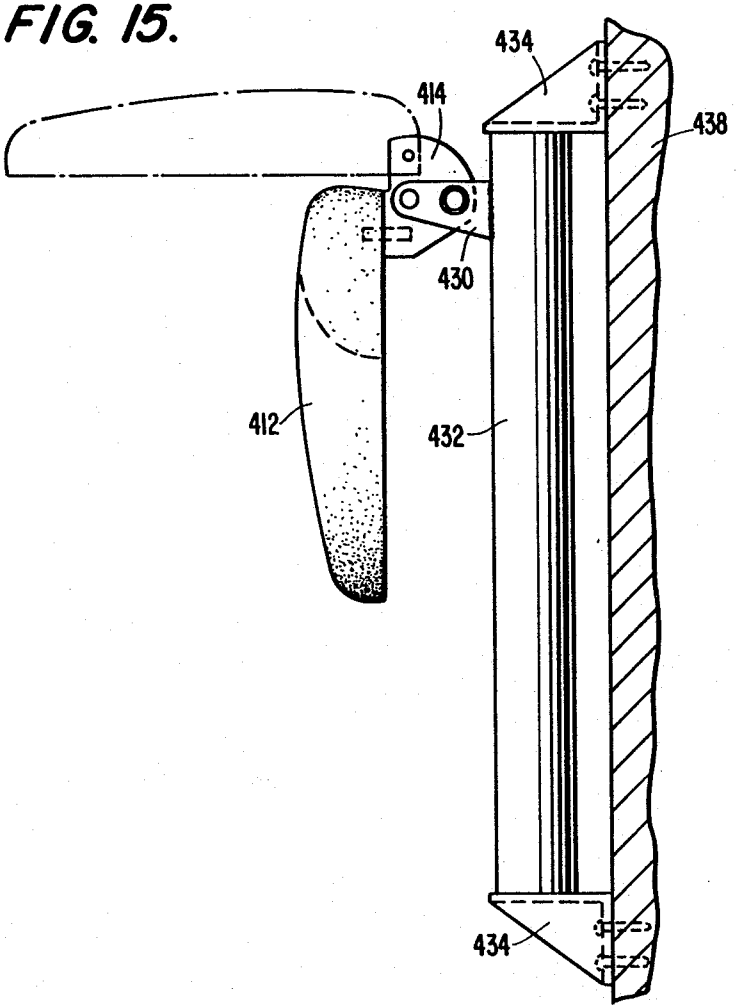
FIG. 15 is a side elevational view of a fifth alternative embodiment for the invention, showing the operative position for the seat in phantom, with the seat fixedly secured to a single wall-mounted column.

A fifth alternative embodiment for the invention is shown in FIG. 15. The seat member 412 is operatively associated with support flanges 430 by means of segment plate 414 as has heretofore been described. The support flanges 430 are fixedly secured to a central support post 432 having securing flanges 434 at its upper and lower ends. The securing flanges are fixedly mounted to the wall 438. Hence, the embodiment of FIG. 15 is intended to be placed at the desired vertical height by the user by mounting the support post upon the wall at the desired vertical location.

Figure 16:
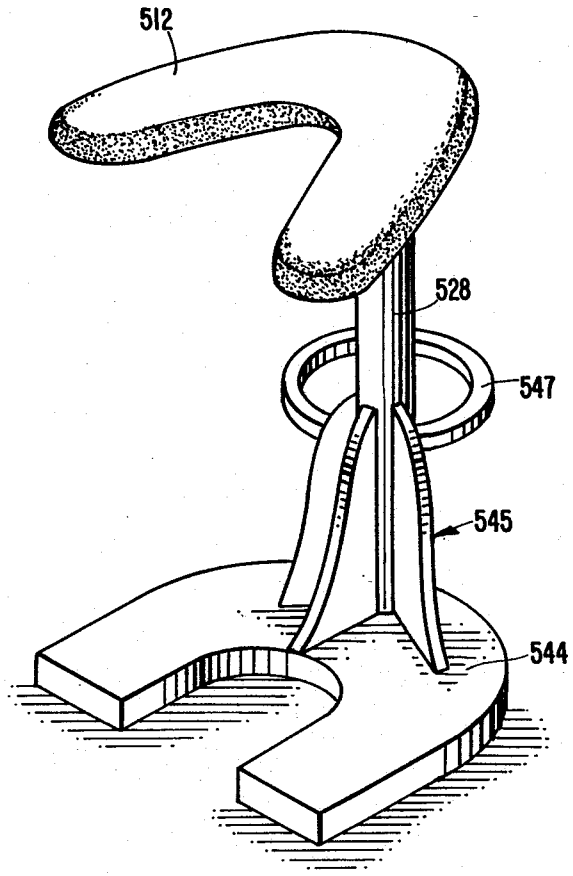
FIG. 16 is a pespective view of a sixth alternative embodiment for the invention, showing the seat member fixedly attached to the top of a single vertical support.

The sixth and final alternative embodiment for the body supporting chair is depicted in FIG. 16. The seat member 512 is fixedly secured to and mounted upon the upper end of a support post 528. The lower end of the support post is secured to a base 544. A plurality of gusset plates 545 extends from the front of the support post to the base for stabilization. A foot support 547 encircles the support post.

Although the present invention has been particularly described in connection with a preferred and several alternative embodiments, it is apparent that many modifications, revisions and additions to the invention as defined herein may be made by one skilled in the art without departing from the spirit and scope of the invention as defined in the appended claims.

What is claimed is:

1. A body supporting chair comprising only a seat member of generally U-shaped configuration defined by an arcuate rear portion and a pair of side portions, said seat member having a bottom surface, a seat support segment plate associated with said bottom surface of said seat member substantially at the center of said arcuate portion for supporting said bottom surface, upstanding swivel means projecting upwardly from said segment plate and being associated with said bottom surface about which said seat member is adapted to pivot in a horizontal plane from side to side about the vertical axis through said swivel means, flange means for securing said seat member with respect to a seat support member, said seat support member being adapted to support said seat member above a generally horizontal support surface, said segment plate being adapted for rotation with respect to said flange means such that said seat member may assume an operative position wherein said seat member lies generally perpendicular to said support member, and an inoperative position wherein said seat member lies generally parallel to said support member, seat locking means for positively securing said seat member in said operative position, support locking means associated with said support member for securing said seat member at any one of a plurality of closely spaced heights above said horizontal support surface.

2. The body supporting chair recited in claim 1 wherein said seat locking means includes a spring-loaded detent assembly operatively associated with said flange means and said segment plate to releasably secure said segment plate against rotation with respect to said flange means.

3. The body supporting chair recited in claim 1 wherein said support member is a vertical support post.

4. The body supporting chair recited in claim 1 wherein said support member is a bracket member, said bracket being mounted on a vertical support surface disposed perpendicular to said horizontal support surface.

5. The body supporting chair recited in claim 3 wherein said support post is hollow, said support post has a lower end received within a sleeve support member, said sleeve support member is mounted upon a base member which is supported on said horizontal support surface, a spring is disposed within said sleeve support member tending to urge said support post upwardly, said support locking means is a spring-loaded detent assembly associated with said support post and with said sleeve support member for securing said support post against vertical movement within said sleeve support member at a desired vertical height.

6. The body supporting chair recited in claim 3 wherein said support post is solid, said support post has a lower end received within a sleeve support member, said sleeve support member is mounted upon a base member which is supported on said horizontal support surface, said support locking means is a hydraulic pump adapted to move said support post upwardly with respect to said sleeve support member and secure said support post at a desired vertical height.

7. The body supporting chair recited in claim 4 wherein said flange means is secured to said bracket, said support locking means is track means mounted on said vertical support surface, said bracket beings secured to said track means at a desired vertical height, said track means being adapted to allow said bracket member to be secured to said track means at any one of a number of closely spaced increments of vertical height.

8. The body supporting chair recited in claim 3 wherein said flange means is provided with an upper sleeve member slidably disposed over the upper end of said support post, the lower end of said support post is received within a fixed lower sleeve member, a spring disposed around said support post tending to urge said upper sleeve upwardly with respect to said support post, said support locking means is a spring-loaded detent assembly associated with said upper sleeve member and said support post for securing said upper sleeve member against vertical movement on said support post at a desired vertical height.

9. The body supporting chair recited in claim 8 wherein said upper end of said support post and said lower sleeve members are secured to a vertical support surface.

10. The body supporting chair recited in claim 3 wherein said support post has a circular cross-sectional configuration.

11. The body supporting chair recited in claim 3 wherein said support post has a non-circular configuration.

12. The body supporting chair recited in claim 1 wherein said support member has an upper end, and a combined tray and clothes hanger member is mounted on said upper end.

13. The body supporting chair recited in claim 5 further comprising means for preventing rotation of said support post within said sleeve support member.

14. The body supporting chair recited in claim 13 wherein said means for preventing rotation is a projection provided on said sleeve member received with a groove formed in said support post.

15. The body supporting chair recited in claim 1 further comprising means for vibrating said seat member.

16. A body supporting chair comprising only a seat member of generally U-shaped configuration defined by an arcuate rear portion and a pair of side portions, said seat member having a bottom surface, a seat support segment plate having an upper edge associated with said bottom surface of said seat member substantially at the center of said arcuate portion, upstanding swivel means projecting upwardly from said upper edge of said segment plate and being associated with said bottom surface about which said seat member is adapted to pivot from side to side in a horizontal plane about the vertical axis through said swivel means, flange means for securing said seat member with respect to a seat support member, said upper edge of said segment plate having a first portion for supporting said bottom surface of said seat member and a second portion for engagement with said flange means, said seat support member being adapted to support said seat member above a generally horizontal support surface, said segment plate being adapted for rotation with respect to said flange means such that said seat member may assume an operative position wherein said seat member lies generally perpendicular to said support member, and an inoperative position wherein said seat member lies generally parallel to said support member, seat locking means for positively securing said seat member in said operative position, support locking means associated with said support member for securing said seat member at any one of a plurality of closely spaced heights above said horizontal support surface.

* * * * *